US005619967A

United States Patent [19]

Streib

[11] Patent Number: 5,619,967

[45] Date of Patent: Apr. 15, 1997

[54] METHOD AND ARRANGEMENT FOR CONTROLLING AN INTERNAL COMBUSTION ENGINE OF A VEHICLE

[75] Inventor: Martin Streib, Vaihingen, Germany

[73] Assignee: Robert Bosch GmbH, Stuttgart, Germany

[21] Appl. No.: 588,437

[22] Filed: Jan. 18, 1996

[30] Foreign Application Priority Data

Jan. 18, 1995 [DE] Germany ..... 195 01 299.2

[51] Int. Cl.[6] ..... F02D 37/02; F02D 41/06; F02D 43/04

[52] U.S. Cl. ..... 123/399; 123/406; 123/421

[58] Field of Search ..... 123/361, 399, 123/403, 406, 415, 416, 421

[56] References Cited

U.S. PATENT DOCUMENTS 4,351,297 9/1982 Suematsu ..... 123/421
4,524,745 6/1985 Tominari et al. ..... 123/399 X
5,095,874 3/1992 Schnaibel et al. ..... 123/361
5,273,016 12/1993 Gillespie et al. ..... 123/413 X

*Primary Examiner*—Tony M. Argenbright
*Attorney, Agent, or Firm*—Walter Ottesen

[57] ABSTRACT

A method controls an internal combustion engine of a motor vehicle. The engine is supplied with air and has an ignition angle and the engine is equipped with a control unit for adjusting at least the air supplied to the engine and the ignition angle. In the method, a driver command for the control unit is detected which can be realized by effecting a change of the air supplied to the engine. The air supplied to the engine and the ignition angle are adjusted during an operating state of the engine in dependence upon the driver command. In this way, the change of the air supplied to the engine is reduced which is required to fulfill the driver command.

8 Claims, 6 Drawing Sheets

METHOD AND ARRANGEMENT FOR CONTROLLING AN INTERNAL COMBUSTION ENGINE OF A VEHICLE

FIELD OF THE INVENTION

The invention relates to a method and an arrangement for controlling the internal combustion engine of a vehicle.

BACKGROUND OF THE INVENTION

The control of internal combustion engines is configured in particular with a view to reducing the emission of toxic substances and optimizing the composition of the exhaust gases. Transient processes such as acceleration processes are, in this regard, critical operating states since they are responsible for brief deviations from the ideal mixture composition. Very rapid changes in the air mass supplied to the internal combustion engine have particularly negative effects on the mixture composition when the internal combustion engine is cold.

In order to optimize the composition of the exhaust gases during transient processes various approaches have been proposed. Thus, it is known, for example from U.S. Pat. No. 5,095,874, to adjust the fuel supply to the internal combustion engine in dependence upon the activation of the accelerator pedal. The air supply is then controlled in a way which optimizes the mixture composition on the basis of the quantity of fuel pregiven by the driver taking into account a wall film model, as may be required.

The entire right, title and interest to the present application and to U.S. patent application Ser. No. 08/378,020, filed Jan. 25, 1995, are assigned to the same assignee, namely, Robert Bosch GmbH of Stuttgart, Germany. U.S. patent application Ser. No. 08/378,020 discloses that the maximum rate of change of the air mass or air quantity is limited in the warm-up phase of the internal combustion engine in order to reduce the emission of toxic substances within the scope of an electronic control of the air supply to the engine in dependence upon the driver command.

The objective of all known proposals is to limit the rate of change in the air mass per time unit or to optimize the air/fuel system dynamically. However, if a given change in the driver command is to be realized, a corresponding change in the air supply must always be realized, if only with a limited rate of change.

U.S. Pat. No. 4,351,297 discloses that the ignition angle of the internal combustion engine is changed in the retard direction in order to heat up the catalytic converter more rapidly when the internal combustion engine is cold.

SUMMARY OF THE INVENTION

The object of the invention is to reduce the absolute amount of the required change in the air supply given a corresponding driver command with a view to reducing the emission of toxic substances.

The method of the invention controls an internal combustion engine of a motor vehicle. The engine is supplied with air and has an ignition angle and the engine is equipped with a control unit for adjusting at least the air supplied to the engine and the ignition angle. The method includes the steps of: detecting a driver command for the control unit which can be realized by effecting a change of the air supplied to the engine; and, adjusting the air supplied to the engine and the ignition angle during at least one operating state of the engine in dependence upon the driver command so as to at least reduce the change of the air supplied to the engine required to fulfill the driver command.

The procedure according to the invention has the advantage that, in particular for the transition from idle to part load and in the case of transient processes in the part-load range, the rate of change in the air mass which is necessary to realize a corresponding change in the driver command is smaller and can even be entirely avoided at the transition to the lower part load.

Thus, it is advantageously ensured that the deviations in the mixture composition from the ideal value become substantially smaller and thus the emission of toxic substances is reduced.

Particular advantages of the procedure according to the invention result during the warm up of the internal combustion engine in combination with an adjustment to retard ignition angle in order to heat up the catalytic converter.

It is particularly advantageous that measures can be taken which permit the procedure of the invention to proceed when there is no change in the torque supplied by the engine. As a result, the poorer heating of the catalytic converter associated with the invention is compensated as far as possible.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
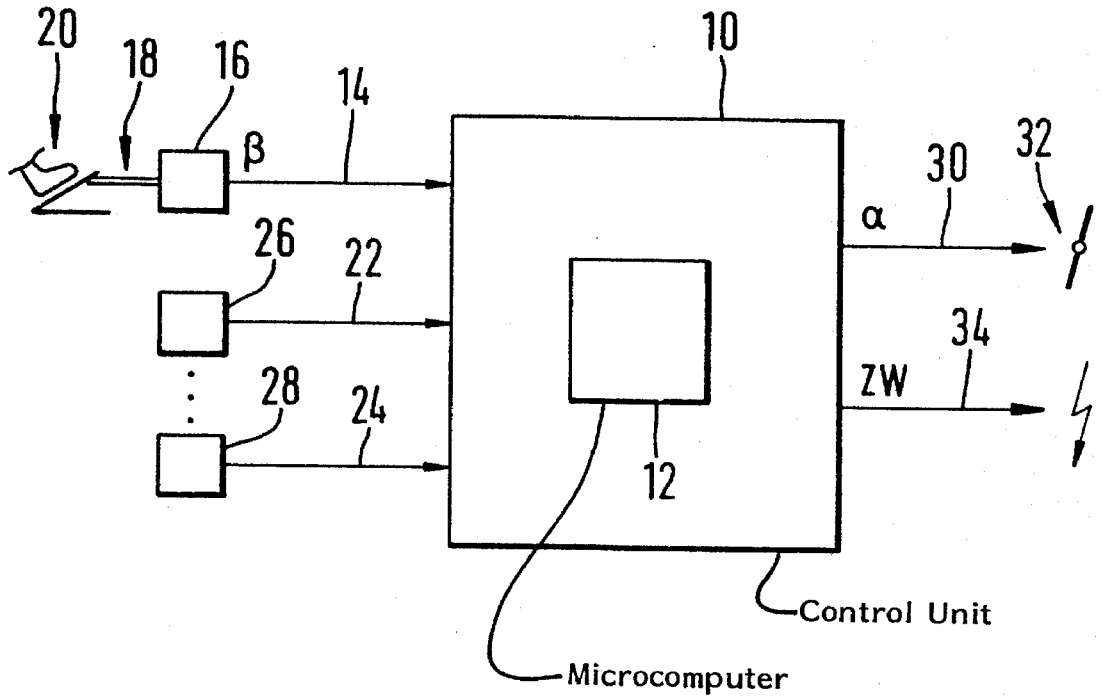
FIG. 1 shows a functional block circuit diagram of a control arrangement for an internal combustion engine.

In FIG. 1, a control unit 10 comprises at least one microcomputer 12. The input line 14 is led to the control unit 10 from a measuring device 16 detecting the driver command. The measuring device 16 is connected via a mechanical connection 18 to a control element 20, preferably an accelerator pedal, which can be actuated by the driver. In addition, input lines 22 to 24 connect the control unit 10 to measuring devices 26 to 28, respectively.

The line 30 is an output line of the control unit 10 and permits electrically actuating a control element 32, for example a throttle flap, which influences the air supply to the internal combustion engine. The line 34 is another output line of the control unit 10 and permits setting the ignition time point. The control unit 10 has further output lines for controlling the metering of fuel, for controlling an automatic transmission as may be needed and/or for controlling the brake system of the vehicle.

The control unit 10, that is the microcomputer 12, executes various functions for controlling the internal combustion engine such as, for example, metering fuel and setting the air supply and the ignition angle. In the context of the invention, the electrical control of the air supply and the setting of the ignition angle are of particular interest. For this reason, only these two functions will be explained in greater detail below. The control unit 10, or the microcomputer 12, detects the driver command via the input line 14 on the basis of the actuating signal β. The actuating signal β is converted into a desired value for setting the air supply, taking into account, as may be required, further operating variables such as the engine speed, gear setting, travel speed, et cetera, which are inputted via the lines 22 to 24. This desired value is set by actuating the control element 32.

In a preferred embodiment, the desired value is the desired setting of a throttle flap which influences the air supply and is set within the scope of a control circuit. In addition, the control unit, that is, the microcomputer 12, receives via the input lines 22 to 24, an engine speed signal and a load signal from the corresponding measuring devices. The microcomputer 12 determines from the engine speed and load signals the ignition angle ZW of the internal combustion engine in a manner known per se by means of a preprogrammed characteristic field. This ignition angle ZW is outputted via the line 34. The load signal can be, in particular, air mass signals or intake pipe pressure signals. In the normal operating state, the ignition angle is determined by the predetermined characteristic field. When the engine is cold and during the warm-up phase of the engine, the ignition angle is, however, shifted in the retard direction, independently of the predetermined characteristic field, in order to heat up the catalytic converter more rapidly. This takes place especially in the idle state and in the operating range which is close to idle.

According to the invention, there is provision, given a command of the driver to increase power, to realize this increase in power not only by increasing the charge or supply (that is, the air supply) but also to correspondingly to reduce the shift of the ignition angle in the retard direction with essentially constant charge or with a reduced rate of change in the charge. In other words, the driver command, which is identified from the setting value of the operator-controlled element, is converted in such a way that, for example during idle and in the part-load range near idle, the supply and thus the setting of the throttle flap is kept essentially at the idle value but the ignition angle is shifted from retard in the direction of advance in accordance with the driver command. The dependence of the ignition angle adjustment on the driver command is pregiven. The supply is only increased, in accordance with the value of the accelerator pedal, if the value of the accelerator pedal or the driver command has exceeded a threshold which is to be specified.

In a second advantageous embodiment, the supply is increased even with small pedal settings but the absolute value of the change is substantially smaller than would be necessary to realize the power request solely on the basis of the change in supply. In parallel with the change in supply, the ignition angle is also adjusted in the advance direction. The respective absolute values of change are pregiven in such a way that the interaction of the two measures results in the power requested by the driver.

According to an advantageous feature, when there is a movement of the accelerator pedal from idle into the lower part-load range or within the lower part-load range, the ignition angle is initially briefly shifted in the advance direction and the increase in torque requested by the driver is thus realized immediately. Then, the supply and thus the setting of the throttle flap, is increased ramp-like as a function of time and the ignition angle is synchronously readjusted ramp-like in the retard direction. The dependence of the changes on time is pregiven in such a way that the process is essentially torque-neutral, that is, there is essentially no change in the torque output of the engine. As a result, possible disadvantages for a more rapid heating of the catalytic converter which occur as a result of the shift of the ignition angle are compensated. This disadvantage is thus only present briefly during the dynamic processes and therefore on average is virtually insignificant.

In one preferred embodiment, the measures described above are only carried out when the internal combustion engine is cold during the warm-up phase until a predetermined engine temperature or catalytic converter temperature is reached. This is applied to engine control systems in which the ignition angle is adjusted in the retard direction only during the warm-up phase. In engine control system in which the ignition angle is always shifted in the direction of retard during idle, the procedure according to the invention is advantageously applied over the entire operating range of the engine. In particular, it is possible, by suitable configuration of the engine control, to realize the procedure according to the invention in that the ignition angle is shifted in the retard direction in particular in the idle state of the engine.

In addition to a control element in the form of a throttle flap which can be adjusted over the entire operating range, a flap is utilized as a control element which can only be adjusted in the idle air range or in the range near idle. In addition, the invention can advantageously be used during transient operations in all those operating states in which a retarded ignition angle is set.

Advantageous embodiments of the invention are illustrated with reference to the flowchart of FIG. 2 and the diagrams of FIGS. 3*a*, 3*b*, 4*a*, 4*b* and 4*c*.

Figure 2:
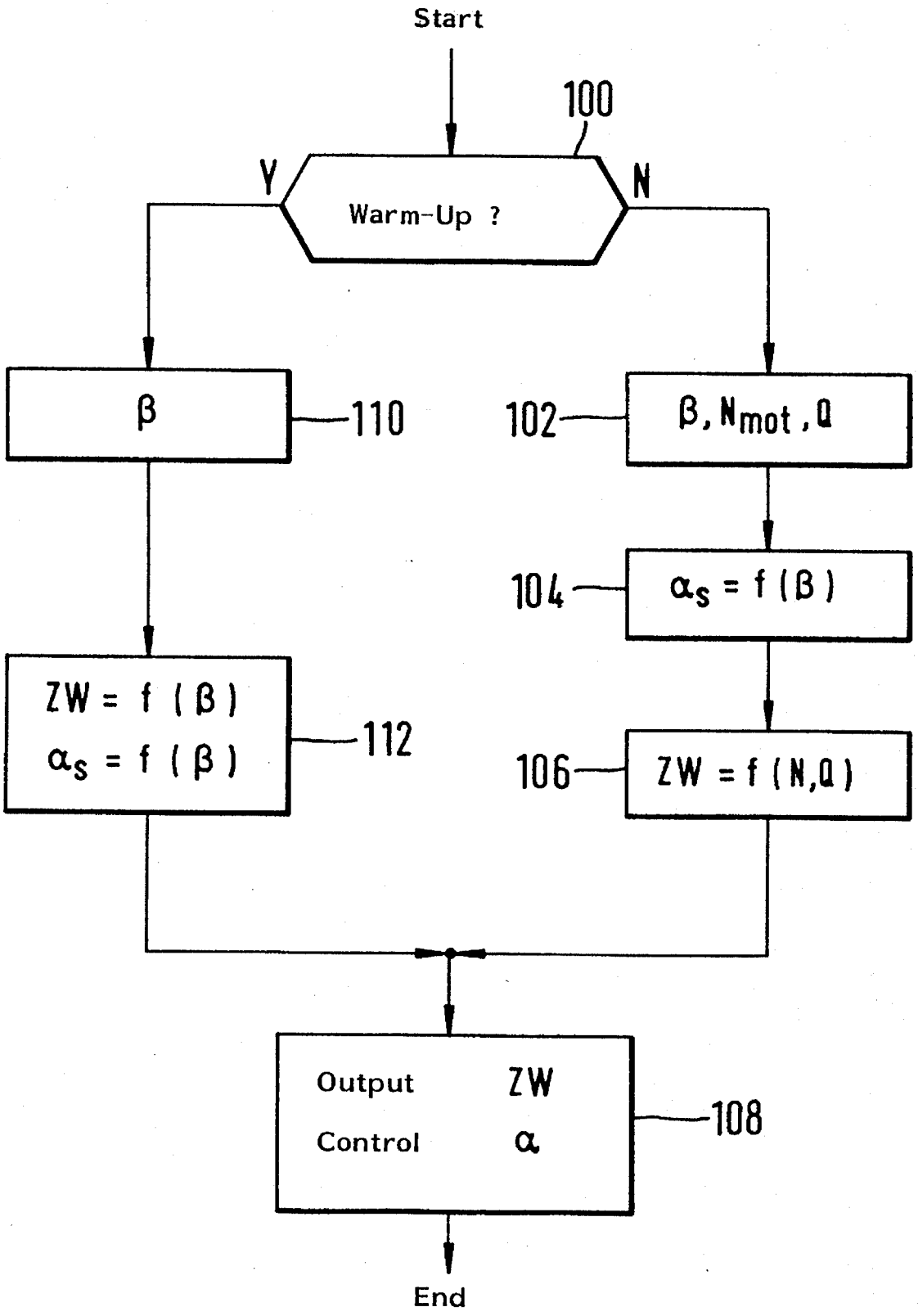
FIG. 2 shows an embodiment of the method of the invention as a computer program in the context of a flowchart.

After the subprogram is started in FIG. 2 at pregiven time points, a check is made in a first step 100 as to whether the internal combustion engine is in the warm-up state. This check takes place preferably with reference to a threshold value for the engine temperature which the engine temperature exceeds when the warm-up phase is terminated. In addition, in a supplementary or alternative manner, a threshold value can be provided for the catalytic converter temperature. If the engine is not in the warm-up phase but rather in the normal operating range, then, in step 102, the setting β of the accelerator pedal, the engine speed $N_{mot}$ and engine load Q are read in, and in the following step 104, the throttle flap desired value $\alpha_s$ and thus the supply are determined on the basis of the accelerator pedal value β and, if required, on further operating variables such as engine speed, gear setting, et cetera from a characteristic field or a characteristic line. Correspondingly, the ignition angle ZW is determined in the following step 106 from the predetermined characteristic field on the basis of the engine speed $N_{mot}$ and the load Q. After the ignition angle ZW and the desired setting of the throttle flap $\alpha_s$ are determined, the ignition angle ZW is outputted in step 108 and the control of the throttle flap angle α to the pregiven desired value $\alpha_s$ is executed. Subsequently, the subprogram is terminated and repeated at a given time.

On the other hand, if the internal combustion engine is in the warm-up phase, the value β of the accelerator pedal setting is read-in in step 110. Then, in step 112, the ignition angle ZW and the throttle flap position desired value $\alpha_s$ are read out on the basis of the accelerator pedal setting β in accordance with the characteristic lines or characteristic fields shown in FIGS. 3*a* and 3*b* and, in the following step 108, these values are outputted or reset. Subsequently, the subprogram is terminated.

Figure 3A:
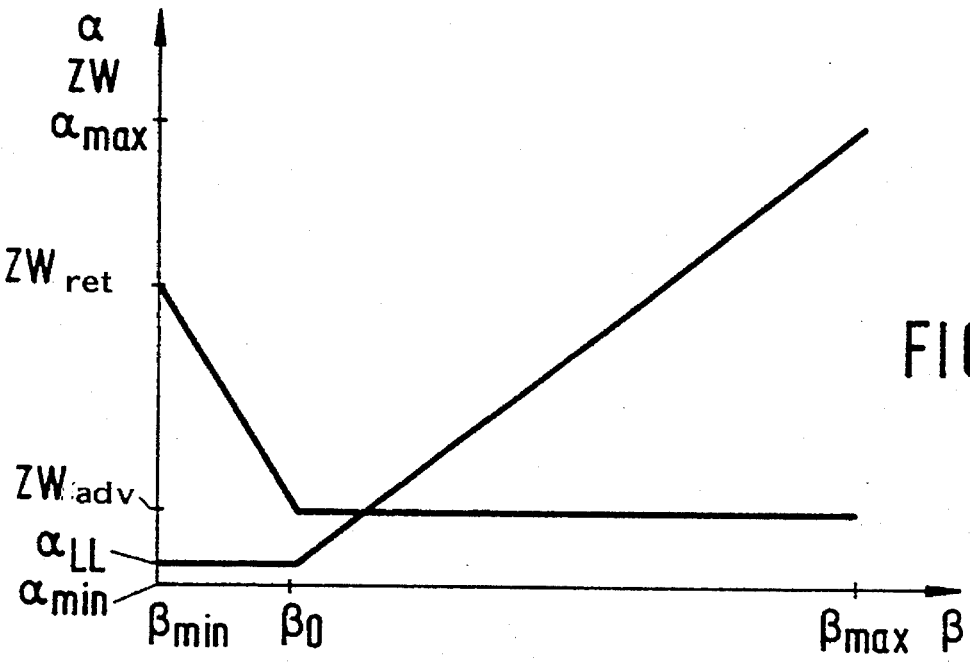
FIGS. 3*a* and 3*b* show the interrelationships between the driver command, the ignition angle and the air supply.
Figure 3B:
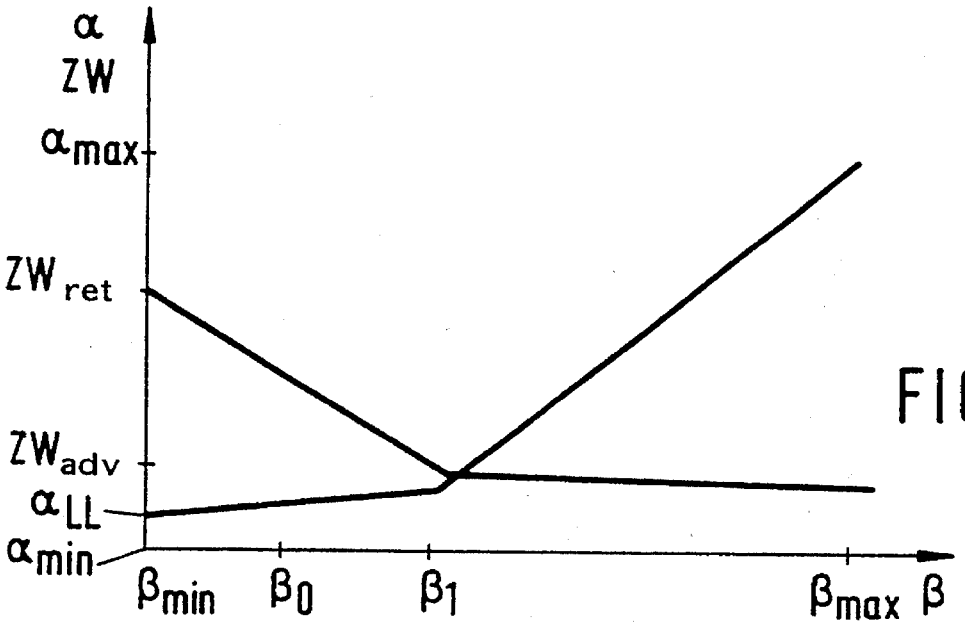

In each of FIGS. 3*a* and 3*b*, the accelerator pedal position value $\beta$ is plotted horizontally, the throttle flap angle $\alpha$ to be set and the ignition angle ZW to be set are plotted vertically. Here, the accelerator pedal position value changes from an idle value $\beta_{min}$, which corresponds to the released accelerator pedal, to a maximum value $\beta_{max}$, which corresponds to the fully actuated accelerator pedal. Correspondingly, the throttle flap and thus the supply can be adjusted from a minimum position value $\alpha_{min}$, which corresponds to the minimum accelerator pedal value, and from a maximum position value of the throttle flap $\alpha_{max}$, which is assigned to the maximum position value of the accelerator pedal. If, as in a preferred embodiment, the idle air is also fed to the engine via the throttle flap, then the opening of the throttle flap with the accelerator pedal released is the idle setting $\alpha_{LL}$ which is set, if required, by an idle control.

In a first advantageous embodiment, the dependence of both the throttle flap angle to be set and of the ignition angle upon the accelerator pedal position is as shown in FIG. 3*a*. Here, in a position range from $\beta_{min}$ to $\beta_0$, the throttle flap angle to be set is kept constant at the idle value $\alpha_{LL}$ or the minimum value $\alpha_{min}$. The ignition angle is shifted from an ignition angle value $ZW_{rel}$ in the advance direction to an ignition angle value $ZW_{adv}$ which corresponds to the position value $\beta_0$. Above the position value $\beta_0$, the throttle flap angle to be set increases as the value of the accelerator pedal position increases; whereas, the ignition angle setting remains essentially constant. Therefore, if the driver actuates the accelerator pedal from $\beta_{min}$ to a value below $\beta_0$, then the power command expressed thereby is realized by shifting the ignition angle. The throttle flap is only actuated when there is an adjustment greater than $\beta_0$.

According to FIG. 3*b*, the range in which the ignition angle is dependent on the accelerator pedal position for realizing power is widened. In the range between $\beta_{min}$ and the limit value $\beta_1$, the throttle flap angle does not remain constant but rather increases slightly, however, to a lesser degree than is the case during normal operation. The ignition angle is then also correspondingly shifted from retard in the advance direction in the range between $\beta_{min}$ and $\beta_1$. Above an accelerator pedal setting value $\beta_1$, the power command is realized by correspondingly adjusting the throttle flap in dependence upon the accelerator pedal setting; whereas, the ignition angle remains essentially constant.

In addition to the linear dependencies illustrated in FIGS. 3*a* and 3*b*, in advantageous embodiments, the dependence can be degressive or progressive. In particular, in an advantageous embodiment, it has proved advantageous to take into account operating variables such as the engine speed, travel speed and/or gear setting when determining the throttle flap value and the ignition angle on the basis of the accelerator pedal value. (Characteristic lines according to FIGS. 3*a* and 3*b* are pregiven for individually selected parameter ranges in such a case. It can also be advantageous in a particular case to input characteristic lines for individual parameter values with the possibility of interpolation at intermediate values.

Figure 4A:
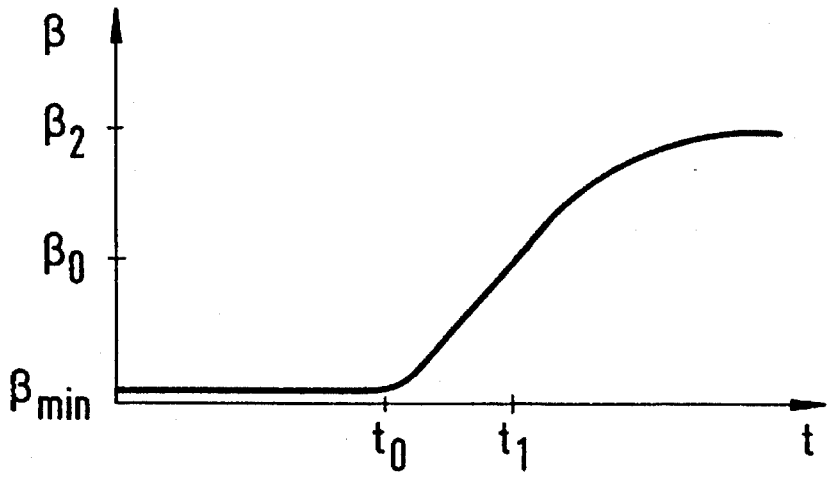
FIGS. 4*a* to 4*c* show time diagrams for this embodiment.
Figure 4B:
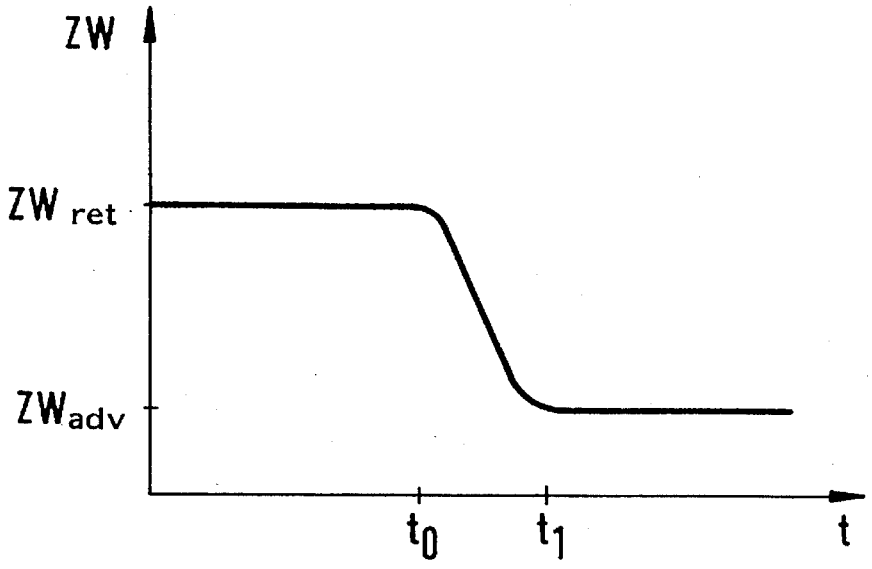
Figure 4C:
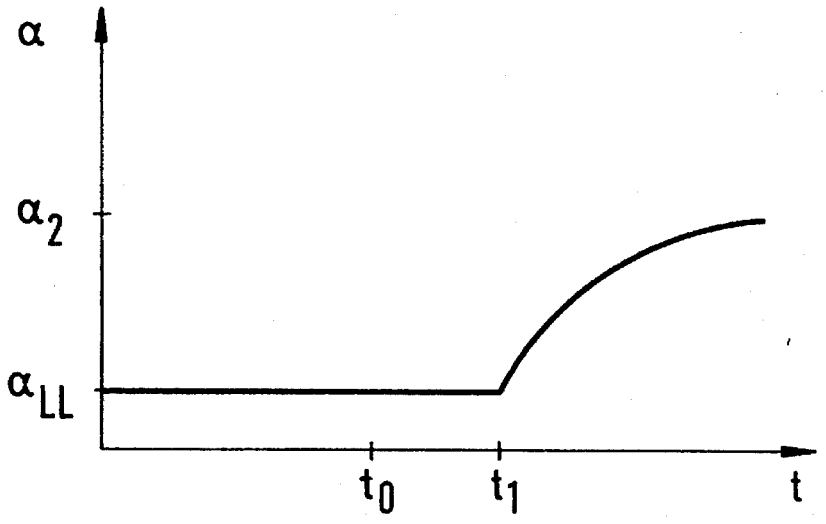

The invention is explained below using the example of the time diagrams according to FIGS. 4*a* to 4*c*. FIG. 4*a* shows the variation of the accelerator pedal position signal as a function of time. FIG. 4*b* shows the variation of the ignition angle as a function of time and FIG. 4*c* shows the variation of the throttle flap angle as a function of time. It is assumed that the accelerator pedal is released up to a time point $t_0$, the accelerator pedal value being $\beta_{min}$. Thereafter, the driver actuates the accelerator pedal, the accelerator pedal position value then exceeds the threshold value $\beta_0$ at time point $t_1$ and is finally brought to its end value $\beta_2$. This leads to a shift of the ignition angle in the advance direction starting from time point $t_0$. This ignition angle shift in the advance direction is terminated when the value $ZW_{adv}$ is reached at the time point $t_1$to which the threshold value $\beta_0$ is assigned. Correspondingly, the throttle flap setting is held at its idle value $\alpha_{LL}$ beyond the time point $t_0$ up to the time point $t_1$ and only after the time point $t_1$, is the throttle flap setting increased in accordance with the driver input until finally, the throttle flap angle $\alpha_2$, which is assigned to the accelerator pedal position value $\alpha_2$, is reached.

In addition to the presentation related to the idle range and lower part-load range, the application of the invention is advantageous in all those operating ranges of the internal combustion engine in which a retard ignition angle is set.

An advantageous further development of the invention is explained with reference to the flowchart of FIG. 5 and the time diagrams according to FIG. 6. The procedure described with reference to FIGS. 2 to 4 can lead in individual cases to disadvantages for a rapid heating up of the catalytic converter as a result of the shift of the ignition angle in the advance direction. Therefore, according to the further development, in the event of an accelerator pedal movement in the at least one operating state with retarded ignition angle setting (for example, up to the limit value $\beta_0$), the ignition angle is initially briefly shifted in the advance direction in order to realize the torque increase requested by the driver. Thereafter, the supply, that is the throttle flap setting, is increased (in a manner corresponding to a ramp signal) such that essentially no transient mixture deviation occurs. In synchronism with this increase of the throttle flap position, the ignition angle is correspondingly shifted in the retard direction again in a manner corresponding to a ramp such that the resulting torque of the engine remains the same. Thus, the possible disadvantage of an adverse heating up of the catalytic converter is present only for a brief time during the dynamic processes. Thus, under realistic conditions this disadvantage is, on average, virtually insignificant.

Figure 5:
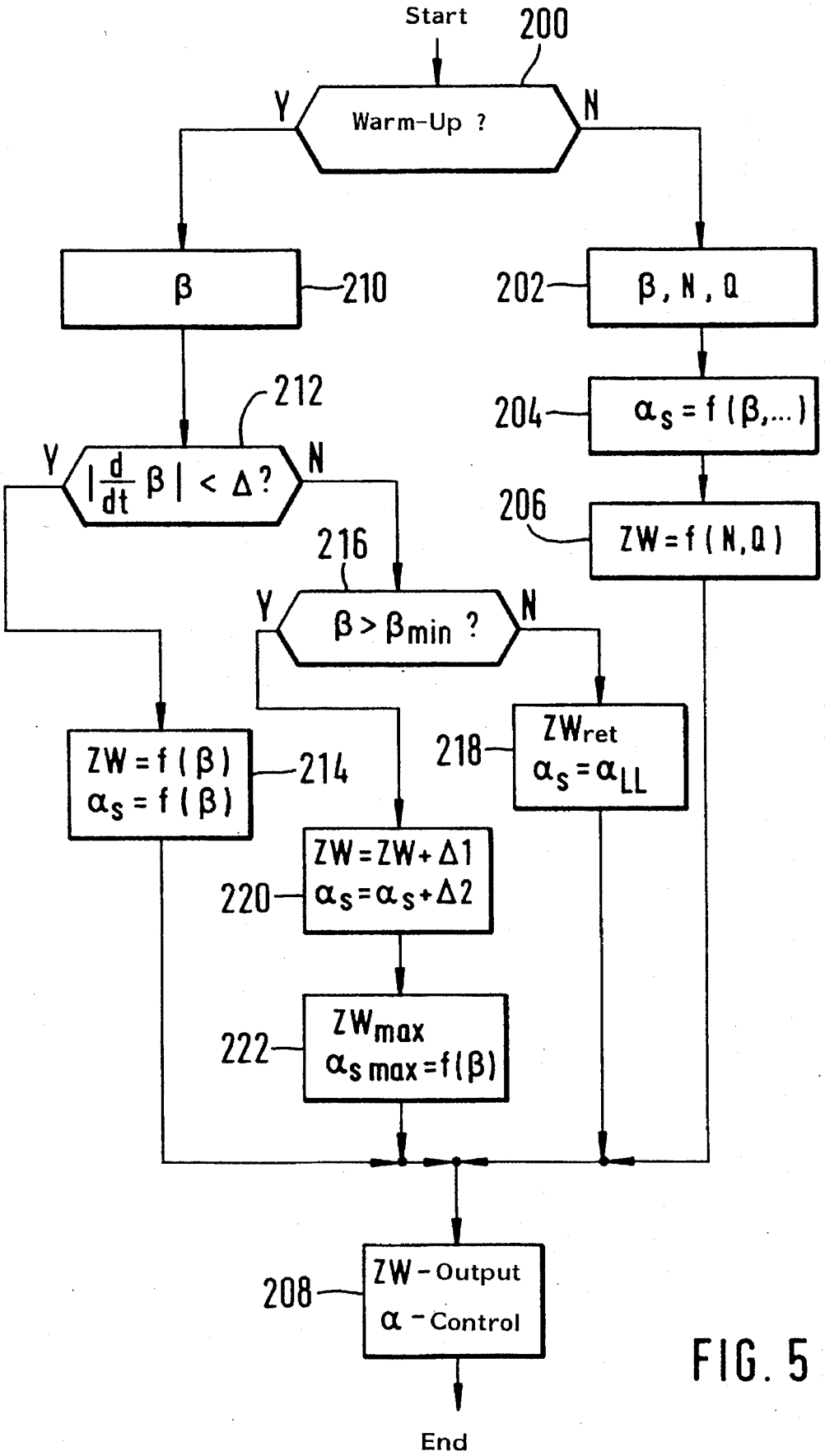
FIG. 5 shows a further advantageous supplement to the invention using the example of a further flowchart; and, FIGS. 6*a* to 6*c* show the time diagrams associated with the embodiment of FIG. 5.

After the start of the subprogram according to FIG. 5, a check is made in the first step 200 as to whether the engine is in the warm-up range. This takes place with reference to the engine temperature and/or catalytic converter temperature. If the engine is outside the warm-up phase, then, in the next step 202, the accelerator pedal position $\beta$, engine speed N and engine load Q are read in and, in step 204, the desired value $\alpha_s$ of the throttle flap position is determined on the basis of the accelerator pedal position $\beta$ and, if required, on further operating variables such as the engine speed and gear setting. Then, in step 206, the ignition angle ZW to be set is read out from the engine-speed/load characteristic field and, in step 208, this read-out ignition angle is outputted and the control of the throttle flap position to the desired value $\alpha_{des}$ is carried out. Thereafter, the subprogram is terminated.

If the internal combustion engine is warming up, then, in step 210, the accelerator pedal position value $\beta$ is read in and, in the following step 212, a check is made as to whether a change in the accelerator pedal position value has occurred. This is determined, for example, from the absolute value of the time derivative of the accelerator pedal position value or the difference between two successive position values. A change in the position is detected if this amount is greater than a pregiven value $\Delta$. If this is the case, then, in step 214, the ignition angle and the value of the throttle flap position are determined on the basis of the accelerator pedal value in accordance with the characteristic lines or fields shown in FIGS. 3*a* and 3*b* and the corresponding values are outputted or adjusted in accordance with step 208. This means that with a change in the accelerator pedal position, the adjustment of the throttle flap and of the ignition angle are executed in accordance with the first two embodiments. If the accelerator pedal movement is terminated or if there is no movement of the accelerator pedal in the sense of step 212, a check is made in inquiry step 216 whether the value $\beta$ of the accelerator pedal position is greater than the value $\beta_{min}$ corresponding to the released accelerator pedal. If this is not the case, that is, if the internal combustion engine is in the idle state, in step 218, a retarded ignition angle is outputted and the desired value of the throttle flap is set to the idle value of the throttle flap. These values are outputted or set in accordance with step 208.

If it was detected in step 216 that the accelerator pedal is actuated, then, in step 220, the ignition angle and throttle flap position are set in opposite directions (in the manner of ramp signals) to the normal setting pregiven in the particular operating state. For this purpose, according to step 220, the ignition angle is shifted in the retard direction by an amount $\Delta 1$ which is dependent on the instantaneous value $\beta$ of the accelerator pedal position. The desired value $\alpha_s$ of the throttle flap is increased by the value $\Delta 2$ which is also dependent upon $\beta$. The amounts $\Delta 1$ and $\Delta 2$ are selected such that, for the instantaneous value of the accelerator pedal position, the changes of ignition angle and throttle flap position do not become manifest in the output torque of the engine. Then, in step 222, if required, the changed ignition angle is limited to the ignition angle ZWnorm which is normal in the present operating state and the desired value $\alpha_s$ of the throttle flap is limited to the normal value which is dependent on the accelerator pedal position in the operating state in question. Thereafter, according to step 208, the values of the ignition angle and throttle flap position which have been calculated in step 220 and, if required, limited in step 222, are outputted or adjusted. Thereafter, the subprogram is terminated.

Figure 6A:
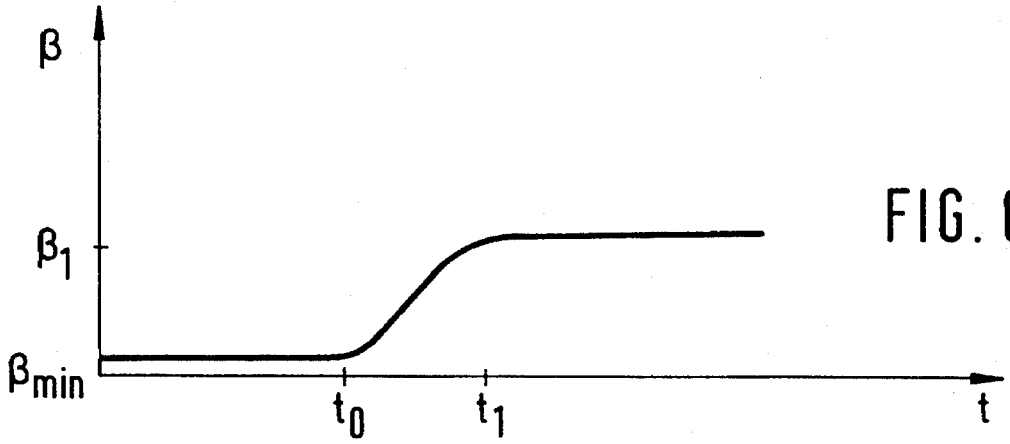
Figure 6B:
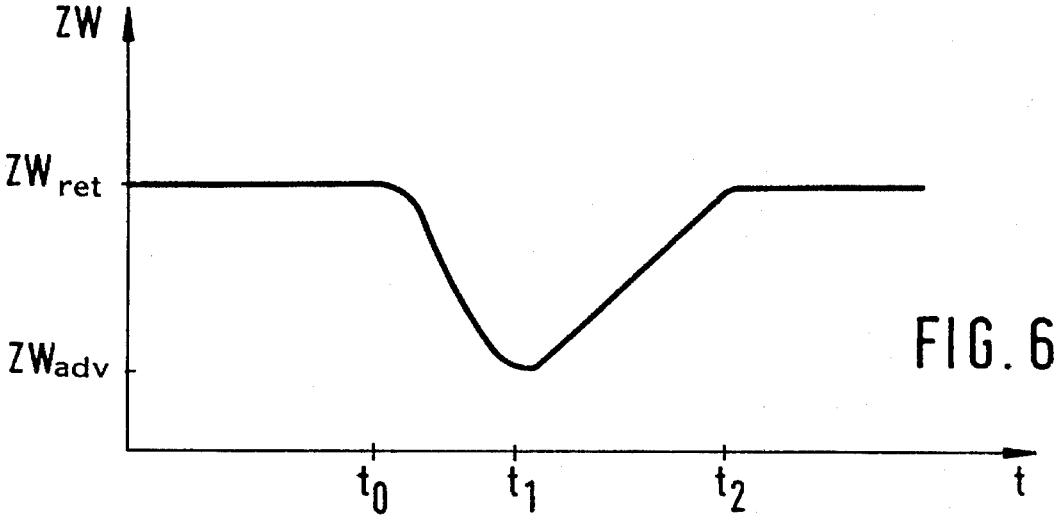
Figure 6C:
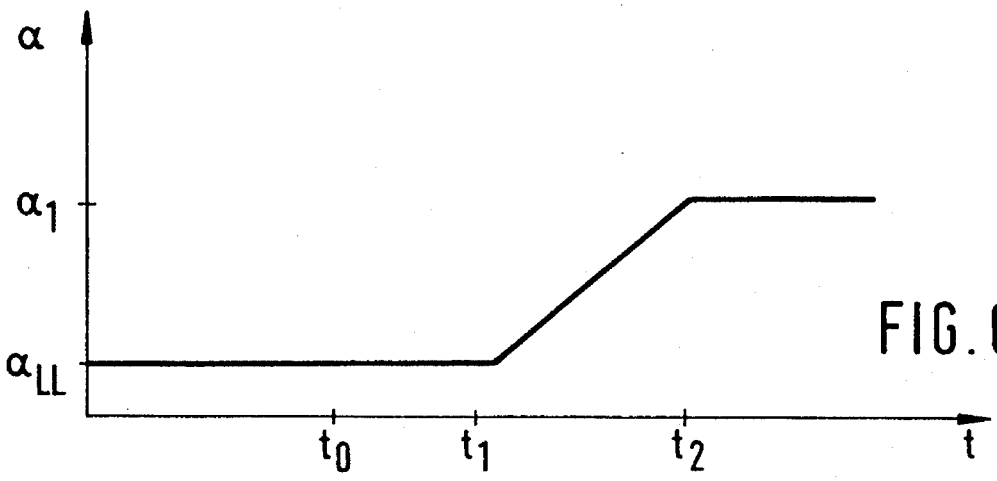

The effects of the procedure illustrated in FIG. 5 are explained in FIGS. 6*a* to 6*c* with reference to time diagrams for an adjustment of the accelerator pedal position from the idle setting into a lower part-load setting.

For this purpose, the accelerator position $\beta$ is plotted as a function of time t in FIG. 6*a*, the ignition angle ZW as a function of time t is plotted in FIG. 6*b* and the value $\alpha$ of the throttle flap position as a function of time t in FIG. 6*c*. The internal combustion engine is in the idle state before a time point $t_0$. The value of the accelerator pedal position corresponds to that of the released accelerator pedal $\beta_{min}$, the ignition angle ZW is shifted to the value ZWret and the value of the throttle flap position corresponds to the idle value $\alpha_{LL}$. At the time point $t_0$, an actuation of the accelerator pedal takes place which is terminated at the time point $t_1$. The value of the accelerator pedal position which is then present corresponds to the value $\beta 1$. According to FIG. 3*a*, as a result of the shift of the accelerator pedal between the time points $t_0$ and $t_1$, the ignition angle ZW is adjusted from the value ZWret to the value ZWadv at the time point $t_1$ as a function of the accelerator pedal position. In this exemplary situation, the value of the accelerator pedal position remains at the idle value up to the time point $t_1$. At time point $t_1$, the actuation of the accelerator pedal is terminated and the increase in torque requested by the driver is realized by the shift of the ignition angle. From the time point $t_1$ up to the time point $t_2$, the ignition angle is again shifted back to the value ZWret in a manner corresponding to a ramp signal, while, in the same time period, the throttle flap angle is adjusted from the idle value to the value $\beta 1$ also in a manner corresponding to a ramp signal. This value $\beta 1$ corresponds to the value for the accelerator pedal setting $\beta 1$, given a linear relationship between the throttle flap position and the accelerator pedal position. The increase in the ramp-shaped shift of the ignition angle and throttle flap position is dependent on the accelerator pedal position value ($\beta 1$). These increases are selected such that no effects on the torque of the internal combustion engine occur.

Correspondingly, an adjustment can be carried out according to FIG. 3*b*.

It is understood that the foregoing description is that of the preferred embodiments of the invention and that various changes and modifications may be made thereto without departing from the spirit and scope of the invention as defined in the appended claims.

What is claimed is:

1. A method for controlling an internal combustion engine of a motor vehicle, the engine being supplied with air and having an ignition angle, the engine being equipped with a control unit for adjusting at least said air supplied to the engine and said ignition angle, the method comprising the steps of:

detecting a driver command for said control unit which can be realized by effecting a change of said air supplied to said engine;

adjusting said air supplied to said engine and said ignition angle during at least one operating state of said engine in dependence upon said driver command so as to at least reduce said change of said air supplied to said engine required to fulfill said driver command; and, said engine undergoing a warm-up phase of operation before reaching normal operation and said operating state being a warm-up phase.

2. The method of claim 1, wherein the adjustment of said ignition angle is dependent upon said driver command in such a manner that, for a pregiven driver command range, the power increase wanted by said driver is realized by a shift of said ignition angle from retard toward advance without an adjustment of said air supplied to said engine.

3. The method of claim 1, wherein the adjustment of said ignition angle is dependent upon said driver command in such a manner that, for a pregiven driver command range, the power increase wanted by said driver is realized by a shift of said ignition angle from retard toward advance with only a slight adjustment of said air supply.

4. The method of claim 1, wherein said engine further includes a driver-actuated element actuated by the driver to input said driver command and a throttle flap for adjusting the air supplied to said engine; and, wherein the method comprises the further steps of:

sensing the position of said driver-actuated element and supplying a signal indicative of said position and said driver command to said control unit;

utilizing said control unit to control the position of said throttle flap; and, modifying the dependency of the position of said throttle flap on said driver command in pregiven states of said engine.

5. A method for controlling an internal combustion engine of a motor vehicle, the engine being supplied with air and having an ignition angle, the engine being equipped with a control unit for adjusting at least said air supplied to the engine and said ignition angle, the method comprising the steps of:

detecting a driver command for said control unit which can be realized by effecting a change of said air supplied to said engine;

adjusting said air supplied to said engine and said ignition angle during at least one operating state of said engine in dependence upon said driver command so as to at least reduce said change of said air supplied to said engine required to fulfill said driver command;

said driver command corresponding to an increase in power outputted by the engine; and, ramp shifting said ignition angle in the retard direction and synchronously changing said air supplied to said engine so that no change occurs in the torque supplied by the engine after said increase in said power is made available.

6. A method for controlling an internal combustion engine of a motor vehicle, the engine being supplied with air and having an ignition angle, the engine being equipped with a control unit for adjusting at least said air supplied to the engine and said ignition angle, the method comprising the steps of:

detecting a driver command for said control unit which can be realized by effecting a change of said air supplied to said engine;

adjusting said air supplied to said engine and said ignition angle during at least one operating state of said engine in dependence upon said driver command so as to at least reduce said change of said air supplied to said engine required to fulfill said driver command;

the engine including a throttle flap for adjusting the air supplied to said engine;

outside of at least one pregiven operating state, adjusting said ignition angle on the basis of engine speed and engine load independently of said driver command; and, adjusting the position of said throttle flap and therefore the air supplied to said engine on the basis of said driver command.

7. A method for controlling an internal combustion engine of a motor vehicle, the engine being supplied with air and having an ignition angle, the engine being equipped with a control unit for adjusting at least said air supplied to the engine and said ignition angle, the method comprising the steps of:

detecting a driver command for said control unit which can be realized by effecting a change of said air supplied to said engine;

adjusting said air supplied to said engine and said ignition angle during at least one operating state of said engine in dependence upon said driver command so as to at least reduce said change of said air supplied to said engine required to fulfill said driver command;

said engine further including an accelerator pedal for making the power generated by said engine available;

shifting said ignition angle in the advance direction when said accelerator pedal is actuated; and, adjusting said ignition angle independently of said driver command while said accelerator pedal is released.

8. An arrangement for controlling an internal combustion engine of a motor vehicle, the engine being supplied with air and having an ignition angle, the engine being responsive to a driver command, the arrangement comprising:

an electronic control unit for adjusting said air supplied to said engine and for adjusting said ignition angle;

a detecting device for detecting said driver command which can be realized by effecting a change of said air supplied to said engine;

said electronic control unit including means for adjusting said air supplied to said engine and said ignition angle during at least one operating state of said engine in dependence upon said driver command so as to at least reduce said change of said air supplied to said engine required to fulfill said driver command; and, said engine undergoing a warm-up phase of operation before reaching normal operation and said operating state being a warm-up phase.

* * * * *

UNITED STATES PATENT AND TRADEMARK OFFICE

CERTIFICATE OF CORRECTION

PATENT NO. : 5,619,967
DATED : April 15, 1997
INVENTOR(S) : Martin Streib

It is certified that error appears in the above-indentified patent and that said Letters Patent is hereby corrected as shown below:

In column 5, line 52: delete "(Characteristic" and substitute -- Characteristic -- therefor.

In column 6, line 11: delete "$\alpha_2$," and substitute -- $\beta_2$, -- therefor.

In column 7, line 66: delete "$\beta_1$" and substitute -- $\alpha_1$ -- therefor.

In column 7, line 67: delete $\beta_1$" and substitute -- $\alpha_1$ -- therefor.

Signed and Sealed this

Fourteenth Day of July, 1998

Bruce Lehman

*Attest:*

BRUCE LEHMAN

*Attesting Officer*

*Commissioner of Patents and Trademarks*